US009371695B2

(12) United States Patent
Zhang et al.

(10) Patent No.: US 9,371,695 B2
(45) Date of Patent: Jun. 21, 2016

(54) INTEGRATED SIDETRACK DRILLING TOOL

(76) Inventors: Lan Zhang, Liaoning (CN); Kaifeng Zhang, Liaoning (CN); Xinyue Zhang, Liaoning (CN)

( * ) Notice: Subject to any disclaimer, the term of this patent is extended or adjusted under 35 U.S.C. 154(b) by 280 days.

(21) Appl. No.: 14/241,871

(22) PCT Filed: Sep. 14, 2012

(86) PCT No.: PCT/CN2012/001264

§ 371 (c)(1),
(2), (4) Date: Feb. 27, 2014

(87) PCT Pub. No.: WO2013/067756

PCT Pub. Date: May 16, 2013

(65) Prior Publication Data

US 2014/0182944 A1 Jul. 3, 2014

(30) Foreign Application Priority Data

Nov. 12, 2011 (CN) ..... 2011 1 0357180

(51) Int. Cl.
*E21B 29/06* (2006.01)
*E21B 7/06* (2006.01)

(52) U.S. Cl.
CPC ..... *E21B 7/061* (2013.01)

(58) Field of Classification Search
CPC ..... E21B 7/061; E21B 29/06
See application file for complete search history.

(56) References Cited

U.S. PATENT DOCUMENTS 5,743,331 A * 4/1998 Adkins ..... E21B 1/10 166/117.6
2009/0266544 A1* 10/2009 Redlinger ..... E21B 4/02 166/298
2013/0020084 A1* 1/2013 Goodson ..... E21B 7/061 166/298

* cited by examiner

*Primary Examiner* — Catherine Loikith
(74) *Attorney, Agent, or Firm* — Prakash Nama; Global IP Services, PLLC

(57) ABSTRACT

An integrated sidetrack drilling tool comprising a milling cone, a whipstock iron and a setting anchor; a liquid guiding pipe communicating the milling cone and the setting anchor is provided inside the whipstock iron; the milling cone presses against an inclined surface of the whipstock iron; an annular groove is provided on a circumference of the milling cone; a portion of the annular groove is an arc shaped clamping slot whose inner side is wider than outer side; other portions of the annular groove constitute a trapezoidal slot whose inner side is narrower than outer side; a portion of the whipstock iron is fixedly provided with a positioning block; an arc shaped clamping edge is provided on the positioning block; the positioning block is held in the arc shaped clamping slot via the arc shaped clamping edge; a positioning screw is provided between the whipstock iron and the milling cone.

6 Claims, 1 Drawing Sheet

INTEGRATED SIDETRACK DRILLING TOOL

BACKGROUND OF THE INVENTION

The present invention relates to a tool for well workovers, and more specifically relates to an integrated sidetrack drilling tool.

A sidetrack drilling tool comprises a whipstock and a milling cone for downhole sidetrack drilling. The whipstock and the milling cone of a conventional sidetrack drilling tool are two separate tools. To perform sidetrack drilling, the whipstock is first mounted onto a feeder and then fed to a predetermined position in the downhole by using a drilling device; next, an inclined surface of the whipstock is adjusted in terms of its orientation as required by the specific design of the sidetrack drilling; after that, fix the whipstock in the downhole by hydraulic or mechanical setting, and then separate the feeder and the whipstock by rotating or pulling and pressing the drilling device; finally, retrieve the drilling device and the feeder and mount the milling cone for sidetrack drilling. Since a sidetrack drilling well is quite deep, it is costly, time consuming and labor intensive every time to descend the drill and then retrieve it up again.

In order to overcome the problems existing in the conventional sidetrack drilling tool and to enhance operating efficiency, both Chinese patent publications under numbers CN2679348 and CN201756914 disclose an integrated drilling device for casing. However, the integrated drilling device for casing as disclosed is restrained by the dimensions of the wellbore, the whipstock and the milling cone, and thus requires more precise coaxiality in the connection between the milling cone and the whipstock. In CN2679348, the milling cone and the whipstock are fixedly connected by screws; since an upper end of the whipstock is a wedge shape end with a pointed tip, a more deviated coaxiality in the connection between the milling cone and the whipstock is resulted, thereby causing much difficulty in descending the drilling device down the well and often causing accidental falling of the whipstock. In CN201756914, the milling cone and the whipstock are connected by a connection sleeve; restrained by the dimensions of the whipstock and the milling cone and the fact that the connection sleeve has to be milled away before drilling an opening, the connection sleeve can only be made thinner and therefore being susceptible to deformation when descending down the well; accordingly, a more deviated coaxiality in the connection between the milling cone and the whipstock is resulted, thereby obstructing the drilling device from descending down to the predetermined position; in fact, no drilling device in this kind of structure has ever been successfully applied in actual practice. Furthermore, the integrated drilling device for casing as disclosed by the two Chinese patent publications has its center of the milling cone being a straight-through axial hole; since this kind of structure cannot release the surge pressure generated by the drilling fluid inside the drilling rod when descending the drilling device, surge pressure generated by obstruction when descending the drilling device can move the slips easily and thereby resulting in improper setting; accordingly, setting will fail and even the well bore has to be abandoned.

BRIEF SUMMARY OF THE INVENTION

The present invention provides an integrated sidetrack drilling tool advantageous in its high operation reliability, improved operation efficiency, lowered operation cost and lowered labor intensiveness. The integrated sidetrack drilling tool of the present invention can ensure coaxiality in the connection between the milling cone and the whipstock, and only requires the drilling device to be descended and retrieved again once to complete fixing the whipstock and using the milling cone to perform sidetrack drilling.

The present invention is attained as follows:

An integrated sidetrack drilling tool of the present invention comprises a milling cone, a whipstock iron and a setting anchor coaxially connected in sequential order; a liquid guiding pipe communicating an inner hole of the milling cone and an inner cavity of the setting anchor is provided inside the whipstock iron; wherein, a lower part of the milling cone presses against an inclined surface of the whipstock iron at an upper part of the whipstock iron; an annular groove is provided on a circumference of the lower part of the milling cone along a circumferential direction; a portion of the annular groove corresponding to the whipstock iron is an arc shaped clamping slot whose inner side is wider than outer side; other portions of the annular groove constitute a trapezoidal slot whose inner side is narrower than outer side; a portion of the whipstock iron corresponding to the annular groove is fixedly provided with a positioning block; an arc shaped clamping edge coordinating with the arc shaped clamping slot and coaxial with the whipstock iron and the milling cone is provided on the positioning block; the positioning block is held in the arc shaped clamping slot via the arc shaped clamping edge; a positioning screw is provided between an upper end of the whipstock iron and the milling cone.

According to the integrated sidetrack drilling tool of the present invention, a portion of the positioning block corresponding to the whipstock iron is cylindrical in shape and is inserted into and welded with the whipstock iron for easier subsequent processing and to ensure the rigidity of the whipstock iron and thereby ensuring operation reliability.

According to the integrated sidetrack drilling tool of the present invention, the inner hole of the milling cone is constituted by a connection screw hole, a central hole and a circulation passage communicating the connection screw hole and the central hole; the connection screw hole and the central hole are holes at an upper part and the lower part of the milling cone respectively; a flow diversion hole is provided at a lower end of the connection screw hole along a radial direction of the milling cone; a conical setting edge is provided at a lower part of the connection screw hole; a setting sphere coordinating with the conical setting edge is also provided. Surge pressure generated by drilling fluid in an inner cavity of a drilling device during descending of the drilling device can be released through the flow diversion hole in order to avoid improper setting of the setting anchor.

According to the integrated sidetrack drilling tool of the present invention, a fixing screw is provided between the positioning block and the milling cone to ensure secured connection between the milling cone and the whipstock iron.

According to the integrated sidetrack drilling tool of the present invention, the setting anchor comprises a cylinder sleeve and a jet pipe fixedly connected to an outer periphery of a lower end of the whipstock iron and to the central part of the whipstock iron respectively, an upper conical body and a lower conical body provided inside the cylinder sleeve, slips extended out of an outer wall of the cylinder sleeve and evenly distributed on and connected to the upper conical body and the lower conical body respectively, a positioning pipe connecting the upper conical body and the lower conical body and provided inside a central hole of the lower conical body, a one-way valve provided at a lower end of the central hole of the lower conical body, and a guide shoe pipe connected to a lower end of the cylinder sleeve; an upper end of the jet pipe is connected with the liquid guiding pipe; a lower end of the jet pipe is inserted into and connected to the upper conical body; elongated holes are evenly distributed on the positioning pipe.

The present invention has the following advantages: According to the present invention, the lower part of the milling cone presses against the inclined surface of the whipstock iron at the upper part of the whipstock iron, the milling cone and the whipstock iron are connected via the positioning screw and the positioning block fixedly connected to the whipstock iron, the arc shaped clamping edge coordinating with the arc shaped clamping slot and coaxial with the whipstock iron and the milling cone is provided on the positioning block, and the positioning block is held in the arc shaped clamping slot via the arc shaped clamping edge. Accordingly, coaxiality in the connection between the milling cone and the whipstock and thereby reliable operation of the present invention can be ensured. Also, since the portion of the annular groove corresponding to the whipstock iron is an arc shaped clamping slot while other portions of the annular groove constitute a trapezoidal slot whose inner side is narrower than outer side, the arc shaped clamping slot and the positioning block can be separated and sidetrack drilling can be performed when the milling cone is rotated after setting of the whipstock. Accordingly, the drilling device is only required to be descended and retrieved again once to complete setting the whipstock and using the milling cone to perform sidetrack drilling, thereby saving the operation time required to descend the drilling device and retrieve it again twice as in other conventional sidetrack drilling tools. Therefore, the present invention has significantly improved operation efficiency, lowered operation cost and lowered labor intensiveness.

Figure 1:
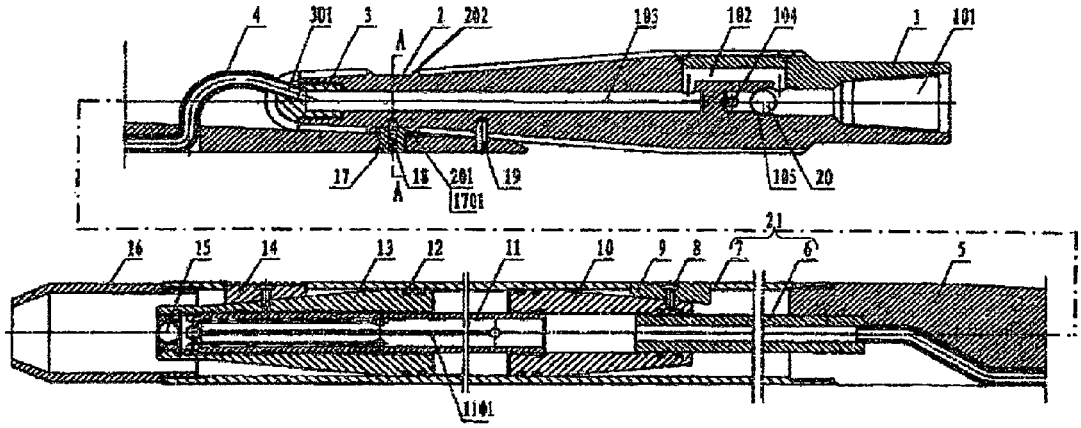
FIG. 1 illustrates the structure of the present invention.
Figure 2:
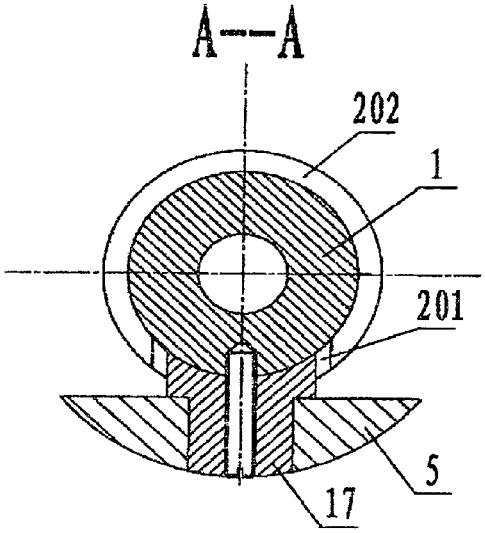
FIG. 2 is a cross-sectional view along line A-A in FIG. 1.

Reference signs in the figures are detailed as follows:

1: milling cone; 101: connection screw hole; 102: circulation passage; 103: central hole; 104: flow diversion hole; setting edge 105; 2: annular groove; 201: arc shaped clamping slot; 202; trapezoidal slot; 3: milling cone head; 301: liquid guiding hole; 4: liquid guiding pipe; 5: whipstock iron; 6: jet pipe; 7: cylinder sleeve; 8: shear screws; 9: radial slips; 10: upper conical body; 11: positioning pipe; 1101: elongated holes; 12: seal rings; 13: lower conical body; 14: longitudinal slips; 15: one-way valve; 16: guide shoe pipe; 17: positioning block; 1701: arc shaped damping edge; 18: fixing screw; 19: positioning screw; 20: setting sphere; 21: setting anchor.

DETAILED DESCRIPTION OF THE INVENTION

As shown in the figures, an integrated sidetrack drilling tool of the present invention comprises a milling cone 1, a whipstock iron 5 connected at a lower part of the milling cone 1 and a setting anchor 21 fixedly connected at a lower end of the whipstock iron 5. A liquid guiding pipe 4 communicating an inner hole of the milling cone 1 and an inner cavity of the setting anchor 21 is provided inside the whipstock iron 5. A milling cone head 3 is fixedly connected at a lower end of the milling cone 1. A liquid guiding hole 301 communicating with the inner hole of the milling cone 1 is provided on the milling cone head 3. An upper end of the liquid guiding pipe 4 extends out of an upper part of an inclined surface of the whipstock iron 5 and then inserts into the liquid guiding hole 301 and welds therewith. The lower part of the milling cone 1 presses against the inclined surface of the whipstock iron 5 at an upper part of the whipstock Iron 5. An annular groove 2 is provided on a circumference of the lower part of the milling cone 1 along a circumferential direction. A portion of the annular groove 2 corresponding to the whipstock iron 5 is an arc shaped clamping slot 201 whose inner side is wider than outer side; other portions of the annular groove 2 constitute a trapezoidal slot 202 whose inner side is narrower than outer side. A portion of the inclined surface of the whipstock iron 5 corresponding to the annular groove 2 is fixedly provided with a positioning block 17. An arc shaped clamping edge 1701 coordinating with the arc shaped clamping slot 201 and coaxial with the whipstock iron 5 and the milling cone 1 is provided on the positioning block 17. The positioning block 17 is held in the arc shaped clamping slot 201 via the arc shaped clamping edge 1701. Portion of the positioning block 17 corresponding to the whipstock iron 5 is cylindrical in shape and is inserted into and welded with the whipstock iron 5. A fixing screw 18 is provided between the positioning block 17 and the milling cone 1. A positioning screw 19 is provided between an upper end of the whipstock iron 5 and the milling cone 1.

The inner hole of the milling cone 1 is constituted by a connection screw hole 101, a central hole 103 and a circulation passage 102 communicating the connection screw hole 101 and the central hole 103; the connection screw hole 101 and the central hole 103 are holes at an upper part and the lower part of the milling cone 1 respectively. A flow diversion hole 104 is provided at a lower end of the connection screw hole 101 along a radial direction of the milling cone 1. A conical setting edge is provided at a lower part of the connection screw hole 101. Entrance of the circulation passage 102 is positioned above the conical setting edge 105. Surge pressure generated by drilling fluid in an inner cavity of a drilling device during descending of the drilling device can be released through the flow diversion hole 104 in order to avoid improper setting of the setting anchor. A setting sphere 20 coordinating with the conical setting edge 105 is also provided.

The setting anchor comprises a cylinder sleeve 7 and a jet pipe 6; the cylinder sleeve 7 is connected at an outer periphery of the lower end of the whipstock iron 5 via screw thread connection and welded therewith; the jet pipe 6 inserts into and welds with the central hole 103 at the lower end of the whipstock iron 5. An upper conical body 10 and a lower conical body 13 are provided inside the cylinder sleeve 7. Radial slips 9 and longitudinal slips 14 extended out of an outer wall of the cylinder sleeve 7 are evenly distributed on and connected at the upper conical body 10 and the lower conical body 13 respectively via shear screws 8. A positioning pipe 11 connecting the upper conical body 10 and the lower conical body 13 is provided inside a central hole of the lower conical body 13. An upper end of the positioning pipe 11 is connected to the upper conical body 10 via coarse screw thread connection. The positioning pipe 11 and the lower conical body 13 are connected via fine tooth shaped screw thread connection. Teeth of the fine tooth shaped screw thread on the positioning pipe 11 point downwardly. A portion on a pipe wall of the positioning pipe 11 corresponding to the lower conical body 13 is evenly distributed with longitudinally arranged elongated holes 1101. A lower end of the central hole of the lower conical body 13 is provided with a one-way valve 15 formed by a steel sphere and a sphere seat. A lower end of the cylinder sleeve 7 is connected with a guide shoe pipe 16. An upper end of the jet pipe 6 is connected with the liquid guiding pipe 4, and a lower end of the jet pipe 6 is inserted into and connected to the upper conical body 10. Seal rings 12 are disposed between the jet pipe 6 and the upper conical body 10, and between the cylinder sleeve 7 and the upper and lower conical bodies.

During operation, connect an upper end of the milling cone 1 to the drilling device; by using the drilling device, descend the integrated sidetrack drilling tool to a predetermined position in the well; adjust the inclined surface of the whipstock iron 5 to a predetermined direction; at the wellbore, drop the setting sphere 20 into the drilling device and activate a pump for recirculation; when the setting sphere 20 reaches the conical setting edge 105 closing the flow diversion hole 104 below, high pressure drilling fluid runs through the inner hole of the milling cone 1, the liquid guiding pipe 4, the jet pipe 6, inner hole of the upper conical body 10 and the positioning pipe 11 in sequential order; since the lower end of the lower conical body 13 is blocked by the one-way valve 15, the high pressure drilling fluid eventually flows in between the upper and the lower conical bodies via the elongated holes 1101. Since the positioning pipe 11 is evenly distributed with the elongated holes 1101 and thereby having some resilience, the drilling fluid will move the upper conical body 10 and drive the positioning pipe 11, causing thread stripping between the positioning pipe 11 and the lower conical body 13. Eventually, the upper and lower conical bodies shear the shear screws 8 and force the radial slips 9 and the longitudinal slips 14 to grip the wall of the well. When pump pressure reaches a predetermined level, stabilize the pressure for 30 seconds and then stop the pump. After that, rotate the drilling device towards a positive direction, and then shear the fixing screw 18 and the positioning screw 19 by using the milling cone 1. The positioning block 17 is then rotated out from the arc shaped clamping slot 201. Continue to rotate the drilling device and the liquid guiding pipe 4 will then be wringed off at the outlet of the liquid guiding hole 301 so that the liquid guiding hole 301 will become a milling cone nozzle. The whipstock iron 5 and the milling cone 1 are now completely separated. Then, the pump can be activated to recirculate the drilling fluid and the drilling device can be rotated and applies pressure for sidetrack drilling.

What is claimed is:

1. An integrated sidetrack drilling tool, comprising:

a milling cone, a whipstock iron and a setting anchor coaxially connected in sequential order; a liquid guiding pipe communicating an inner hole of the milling cone and an inner cavity of the setting anchor is provided inside the whipstock iron; wherein, a lower part of the milling cone presses against an inclined surface of the whipstock iron at an upper part of the whipstock iron; an annular groove is provided on a circumference of the lower part of the milling cone along a circumferential direction; a portion of the annular groove corresponding to the whipstock iron is an arc shaped clamping slot whose inner side is wider than outer side; other portions of the annular groove constitute a trapezoidal slot whose inner side is narrower than outer side; a portion of the whipstock iron corresponding to the annular groove is fixedly provided with a positioning block; an arc shaped clamping edge coordinating with the arc shaped damping slot and coaxial with the whipstock iron and the milling cone is provided on the positioning block; the positioning block is held in the arc shaped clamping slot via the arc shaped clamping edge; and a positioning screw is provided between an upper end of the whipstock iron and the milling cone.

2. The integrated sidetrack drilling tool as in claim 1, wherein a portion of the positioning block corresponding to the whipstock iron is cylindrical in shape and is inserted into and welded with the whipstock iron.

3. The integrated sidetrack drilling tool as in claim 2, wherein a fixing screw is provided between the positioning block and the milling cone.

4. The integrated sidetrack drilling tool as in claim 1, wherein the inner hole of the milling cone is constituted by a connection screw hole, a central hole and a circulation passage communicating the connection screw hole and the central hole; the connection screw hole and the central hole are holes at an upper part and the lower part of the milling cone respectively; a flow diversion hole is provided at a lower end of the connection screw hole along a radial direction of the milling cone; a conical setting edge is provided at a lower part of the connection screw hole; a setting sphere coordinating with the conical setting edge is also provided.

5. The Integrated sidetrack drilling tool as in claim 1, wherein a fixing screw is provided between the positioning block and the milling cone.

6. The integrated sidetrack drilling tool as in claim 1, wherein the setting anchor comprises a cylinder sleeve and a jot pipe fixedly connected to an outer periphery of a lower end of the whipstock iron and to the central part of the whipstock iron respectively, an upper conical body and a lower conical body provided inside the cylinder sleeve, slips extended out of an outer wall of the cylinder sleeve and evenly distributed on and connected to the upper conical body and the lower conical body respectively, a positioning pipe connecting the upper conical body and the lower conical body and provided inside a central hole of the lower conical body, a one-way valve provided at a lower end of the central hole of the lower conical body, and a guide shoe pipe connected to a lower end of the cylinder sleeve; an upper end of the jet pipe is connected with the liquid guiding pipe; a lower end of the jet pipe is Inserted into and connected to the upper conical body; elongated holes are evenly distributed on the positioning pipe.

* * * * *